US011879674B1

(12) United States Patent
Karkhanis

(10) Patent No.: US 11,879,674 B1
(45) Date of Patent: Jan. 23, 2024

(54) EVAPORATIVE COOLING SYSTEM FOR FLUIDS AND SOLIDS

(71) Applicant: Rajiv K. Karkhanis, York, PA (US)

(72) Inventor: Rajiv K. Karkhanis, York, PA (US)

( * ) Notice: Subject to any disclaimer, the term of this patent is extended or adjusted under 35 U.S.C. 154(b) by 0 days.

(21) Appl. No.: 18/118,902

(22) Filed: Mar. 8, 2023

(51) Int. Cl.
*F25B 39/00* (2006.01)
*F25B 39/04* (2006.01)

(52) U.S. Cl.
CPC ..... *F25B 39/00* (2013.01); *F25B 39/04* (2013.01); *F25B 2339/041* (2013.01); *F25B 2339/047* (2013.01); *F28F 2245/02* (2013.01)

(58) Field of Classification Search
CPC .... F25B 39/00; F25B 39/04; F25B 2339/041; F25B 2339/047; F25B 47/00; F25B 47/003; F28F 2245/02
See application file for complete search history.

(56) References Cited

U.S. PATENT DOCUMENTS

| | | | | |
|---|---|---|---|---|
| 6,964,175 | B2 | 11/2005 | Karkhanis | |
| 2010/0012291 | A1* | 1/2010 | Sporie | F24F 5/0035 165/104.34 |
| 2012/0118551 | A1 | 5/2012 | Zettl | |
| 2015/0204626 | A1* | 7/2015 | Martell | F28B 9/04 165/200 |

FOREIGN PATENT DOCUMENTS

| | | | | |
|---|---|---|---|---|
| KR | 20150106230 A | * | 9/2015 | F24F 1/00 |
| KR | 102130616 B1 | * | 7/2020 | F25B 30/00 |
| WO | WO-2021228098 A1 | * | 11/2021 | F25B 39/00 |

OTHER PUBLICATIONS

Pdf is original document of foreign reference KR102130616B1 (Year: 2020).*
Pdf is translation of foreign reference KR 20150106230 A (Year: 2015).*
Pdf is translation of foreign reference WO 2021228098 A1 (Year: 2021).*

(Continued)

*Primary Examiner* — Len Tran
*Assistant Examiner* — Kamran Tavakoldavani
(74) *Attorney, Agent, or Firm* — Joseph E. Maenner; Maenner & Associates, LLC.

(57) ABSTRACT

The current invention provides an evaporative condensing system using an evaporative condenser heat exchanger having an outer surface. The heat exchanger has a superhydrophilic surface. A compressor is configured to circulate a working fluid through the heat exchanger. A water distribution system is adapted to deposit a controlled amount of water on the heat exchanger to absorb heat from the heat exchanger by evaporation of water from the heat exchanger. A collector is located below the heat exchanger to receive excess water from the heat exchanger and direct excess water to a drain and an air delivery system is provided to direct air over the heat exchanger. The water distribution system supplies water to the heat exchanger in sufficient quantity that the water wets the heat exchanger, keeps the heat exchanger wet along its length, and excess water remains to carry dissolved solids to the collector.

22 Claims, 10 Drawing Sheets

(56) References Cited

OTHER PUBLICATIONS

Nakajima et al., "A Superhydrophilic Aluminum Surface with Fast Water Evaporation Based on Anodic Alumina Bundle Structures via Anodizing in Pyrophosphoric Acid". Materials published Oct. 25, 2019.
Fleming. "Silica Nanoparticle-Based Coatings with Superhydrophilic and Superhydrophobic Properties." University of Arkansas. Dec. 2012.
Hu et al. "CFD simulation and validation of self-cleaning on solar panel surfaces with superhydrophilic coating." 2015.
Wemp et al. "Tuning Superhydrophilic Nanostructured Surfaces to Maximize Water Droplet Evaporation Heat Transfer Performance," Journal; of Heat Transfer, Oct. 2018, 140 / 102401-1.

* cited by examiner

| | Evap Temp (Degrees F) | Condensing Temp (Degrees F) | Evaporator Pressure | Condensing Pressure | Capacity (Btus/hr) | Power (Watts) | Compressor EER Efficiency | Current (Amperes) | Percent Increase in Capacity | Percent Reduction in Power Required | Percent Increase in Compressor EER Efficiency |
|---|---|---|---|---|---|---|---|---|---|---|---|
| Current Invention | 50 | 95 | 157 | 310 | 53055 | 2223 | 23.87 | 3.5 | - | - | - |
| Air Cooled (1) | 50 | 120 | 157 | 432 | 45321 | 3104 | 14.6 | 4.6 | 17.1 | 28.4 | 63.49 |
| Water Cooled (3) | 50 | 105 | 157 | 355 | 50058 | 2534 | 19.76 | 3.9 | 6.0 | 12.3 | 20.80 |
| Evaporatively Cooled (4) | 50 | 100 | 157 | 332 | 51572 | 2372 | 21.74 | 3.7 | 2.9 | 6.3 | 9.80 |
| Evaporatively Cooled (5) | 50 | 100 | 157 | 332 | 51572 | 2372 | 21.74 | 2.7 | 2.9 | 6.3 | 9.80 |

FIG. 1A

EVAPORATIVE COOLING SYSTEM FOR FLUIDS AND SOLIDS

BACKGROUND OF THE INVENTION

Field of the Invention

The current invention relates to an evaporative cooling method for fluids such as refrigerant gases, refrigerant liquids, steam, organic compounds, and solids like compressors, and apparatus, such as a condensing apparatus for use with air conditioners and other applications. Evaporative condensing substantially improves the efficiency of the air conditioner. For this illustration, refrigerant condensing is taken as a representative case.

Description of the Related Art

Air conditioners and other devices that need to reject heat at ambient conditions typically use air or water for this purpose. This may be done in one of the following methods:

1. Air at ambient temperature is passed over the heat exchanger containing the medium to be cooled. The Carnot cycle for such a system is depicted by the plot 1*a*, 1*b*, 1*c*, 1*d* in FIG. 1. For the refrigerant R-410A, condensation takes place at 120° F. and 432 PSI.

2. Water from a city supply or other source is passed in a once-through system through a heat exchanger containing the medium to be cooled. The water leaving the heat exchanger is sent to the city drain or a lake. This method is uneconomical and used rarely and is not represented on the Carnot cycle.

3. Water is passed through heat exchanger containing medium to be cooled. After the water cools the medium, this water is sent to a device like a cooling tower where it is cooled by evaporating a portion of water in the ambient air stream. Cooled water is then sent back through the heat exchanger in a continuous loop. Make-up water is added to the system to compensate for three modes of losses:

a. Water that is evaporated to cool the rest of the water.
   b. Water that is lost to the air stream.
   c. Water that is bled off to maintain the dissolved solids to an acceptable level. This amount of bleed off is determined by the level of dissolved solids in the available replacement water and maximum level of dissolved solids in the water to keep the maintenance to acceptable level. The Carnot cycle for this system is depicted by the plot 3*a*, 3*b*, 3*c*, 3*d* in FIG. 1. For the refrigerant R-410A, condensation takes place at 105° F. and 335 psi.

4. Water is evaporated on the surface of the heat exchanger containing the medium to be cooled. A large amount of water is sprayed on the heat exchanger surface, and ambient air is also forced over the heat exchanger containing fluid to be cooled. A very small portion of the water (about 1%) evaporates in the air, taking heat from the fluid inside the heat exchanger. Excess water is collected in a container, typically a water basin at the foot of the heat exchanger. In order to avoid continuous concentration of solids in the remaining water, some water is drained (or bled) from the sump. Water is added to the sump to make up for the water that has evaporated, bled, and lost to air. Above mentioned excess water and make up water is sprayed on the heat exchanger. This process is represented in the Carnot cycle by points 4*a*, 4*b*, 4*c*, 4*d* in FIG. 1. In this cycle, condensation takes place at 100° F. and 332 psi.

5. Water is dripped on the heat exchange surface, which is covered with water absorptive material. Water is evaporated on the surface of the heat exchanger containing the medium to be cooled, and ambient air is also forced over the heat exchanger. The heat exchanger is covered with a water absorptive material. The amount water dripped on the heat exchanger has enough excess water after evaporation to carry away dissolved solids without precipitating on the heat exchanger in form of scales. This process is represented in the Carnot cycle by points 5*a*, 5*b*, 5*c*, 5*d* in FIG. 1. In this cycle, condensation takes place at 100° F. and 332 psi.

Excess water that leaves a heat exchanger without being evaporated carries concentrated dissolved substances away from the heat exchanger surface.

Air at 35° C. (95° F.) dry bulb temperature and 23.89° C. (75° F.) wet bulb temperature may be expected to have a refrigerant condensing temperature of 48.89° C. (120° F.) in air only, using the method described in method 1 above. Whereas water cooled and evaporative cooled equipment described in method 3 above using the same air may be expected to have a refrigerant condensing temperature of 40.56° C. (105° F.).

The method described above in method 1 also requires larger amount of air drawn over the heat transfer surface to carry the heat away, compared with that required in applications described in methods 3 through 5. However, using water to cool in a once through system as described in method 2 requires a large amount of water to be wasted. The cooling tower and recirculation described in method 3 requires additional pumping capacity, additional fan capacity, and considerable maintenance (in terms of chemical additives and physical cleaning) to avoid formation of algae or other microorganisms and to avoid formation of scales. Scale reduces the heat transfer efficiency, or cause corrosion of the heat exchanger. Evaporative condensing as described in method 4 eliminates the need for another device like a cooling tower while achieving temperatures in the medium to be cooled comparable to those obtained by using recirculated water. However, conventional evaporative condenser designs use recirculated water, thus causing maintenance problems previously described with respect to cooling towers. Certain inventions in recent past, described in method 5, have proposed the use of a once-through system of water where water is evaporated in the evaporative condenser. This method, in which the heat exchanger is covered with absorptive material, when heat exchange is stopped residual water on the heat exchanger leaves deposits of minerals previously dissolved in water on the heat transfer surface used, thus reducing the heat transfer efficiency of the heat exchanger and requiring elaborate cleaning and/or replacement of the heat transfer surface. In addition, the absorptive material on heat exchanger generates thermal resistance to heat transfer from heat exchanger to water being evaporated. Finally, dirt and dust getting caught in the absorptive material will reduce the heat exchanger efficiency.

It would be beneficial to provide an improved system and method for providing evaporative cooling.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The current invention overcomes one or more of these deficiencies by providing an evaporative condensing apparatus including an evaporative condenser heat exchanger extending from an upper portion to a lower portion. A compressor is configured to circulate refrigerant gas through the heat exchanger with superhydrophilic surface, and a water distribution system is adapted to deposit a controlled amount of water on various points on the heat exchanger to absorb heat from the heat exchanger by evaporation of water from the heat exchanger. A collector below the lower portion of the heat exchanger receives excess water from the heat exchanger and directs excess water to a drain. An air delivery system directs air over the heat exchanger. The water distribution system supplies water to the upper portion of the heat exchanger in sufficient quantity that the water wets the heat exchanger, keeps the heat exchanger wet from the upper portion to the lower portion, even with the evaporative losses of water, and excess water remains to carry dissolved solids to the collector.

In an exemplary embodiment, the water distribution system supplies only enough water to provide excess water to carry enough dissolved solids to the collector so that scale from precipitated solids in the water does not build up on the heat exchanger in sufficient quantity to degrade thermal transfer performance in a commercially significant amount. In one embodiment the water distribution system includes an adjustment that permits the rate of water flow to be adjusted to achieve a level of water flow to provide excess water in correspondence with an expected dissolved solids concentration in the water.

The air delivery system may include a fan and be configured so that the airflow occurs over the heat exchanger only when the fan motor is turned on and does not occur or occurs minimally when the fan motor is off, even when a strong wind is blowing. In one embodiment the heat exchanger is arrayed around a central volume and surrounded by an air-impervious barrier that is open above and below the heat exchanger, and the air delivery system includes a fan configured to direct air radially inward from below the barrier so the air must turn to pass axially over the heat exchanger when the fan is on. The collector may be configured as a pan that inhibits axial airflow upstream of the radial inward airflow path. This configuration of the air circulation system may also reduce the noise of the compressor heard at five or more feet away from the compressor.

The apparatus may include a compressor proximate the heat exchanger with an upper portion of the compressor subject to heating during operation The water distribution system may be adapted to deposit a controlled amount of water on the heat exchanger on a solid object with superhydrophilic surface, such as a compressor, to cool the so that the object is cooled by evaporation of water on its surface.

In another embodiment, the current invention is an evaporative condensing system comprising an evaporative condenser heat exchanger having an outside and extending from an upper portion to a lower portion. The heat exchanger has a superhydrophilic surface. A compressor is configured to circulate a working fluid through the heat exchanger and a water distribution system is adapted to deposit a controlled amount of water on the heat exchanger to absorb heat from the heat exchanger by evaporation of water from the heat exchanger with superhydrophilic surface. A collector is located below the lower portion of the heat exchanger to receive excess water from the heat exchanger and direct excess water to a drain and an air delivery system is provided to direct air over the heat exchanger. The water distribution system supplies water to the upper portion of the heat exchanger in sufficient quantity that the water wets the heat exchanger, keeps the heat exchanger wet from the upper portion to the lower portion, with the evaporative losses of water, and excess water remains to carry dissolved solids to the collector.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 1A is a chart comparing examples 1, 3, 4, and 5 with the current invention;

DETAILED DESCRIPTION

Figure 1:
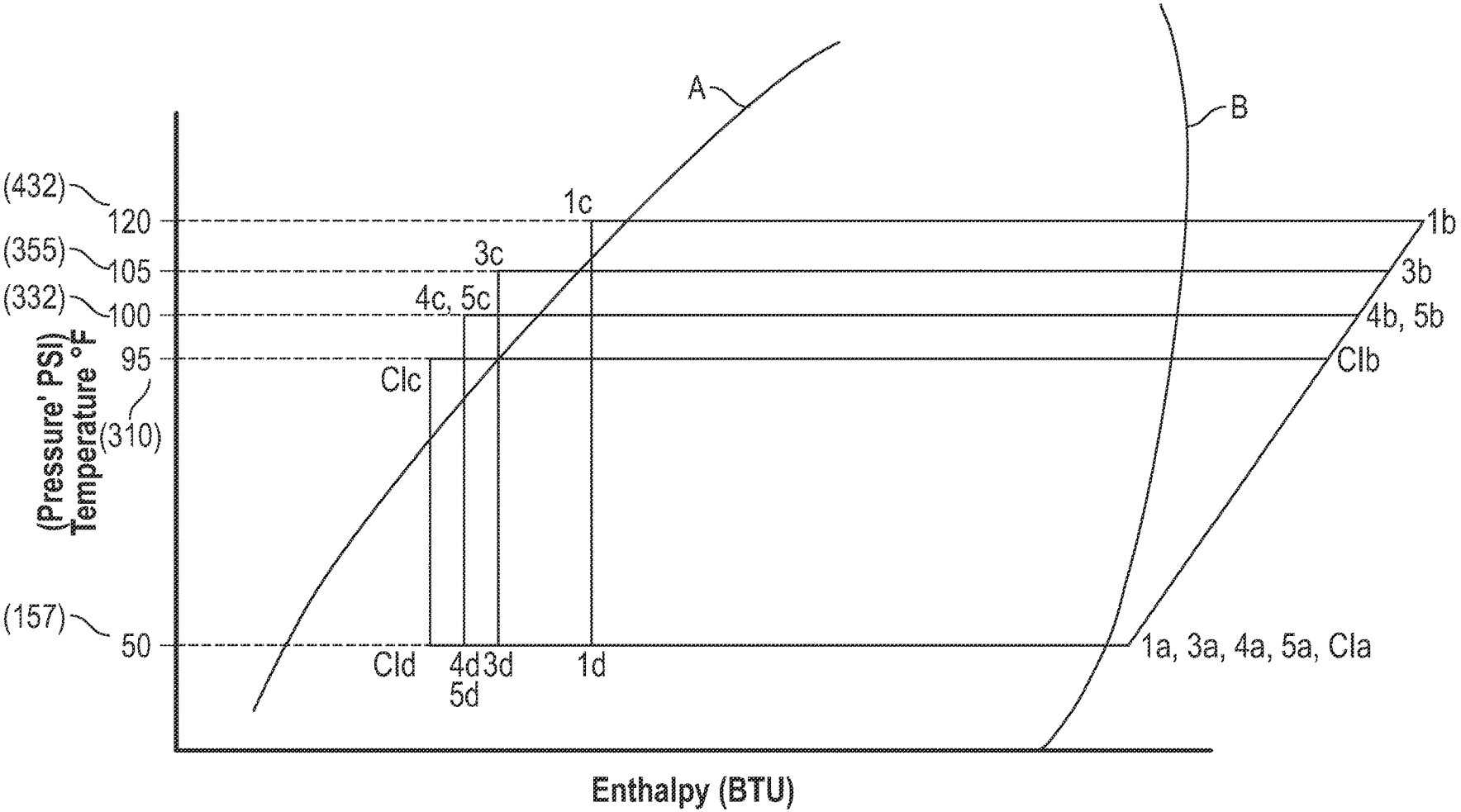
FIG. 1 is a Temperature/Pressure/Enthalpy chart (not to scale) for Refrigerant R-410A with representations of simplified cycles for an embodiment of the current invention and typical refrigerant cycles for evaporatively cooled methods 1, 3, 4 and 5 above, typical water cooled refrigerant cycle and typical air cooled refrigerant cycle (Prior art)

In the drawings like numerals indicate like elements throughout. Certain terminology is used herein for convenience only and is not to be taken as a limitation on the current invention. The terminology includes the words specifically mentioned, derivatives thereof and words of similar import. For the purpose of this invention, a superhydrophilic surface means a surface that has Water Contact Angle (WCA) of less than 10 degrees within 0.5 seconds, when a water drop is placed on the surface or a surface with a property to spread water drop in a thin water film within 0.5 seconds.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the current invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

FIG. 1 shows the pressure-enthalpy during the Carnot cycle for a typically used refrigerant gas, R-410A, in a compressor/evaporator/condenser arrangement that is used in refrigerators, chillers, air conditioners, and heat pumps. The various portion of the cycle pertinent to the current invention visible in FIG. 1 are referred to in the following text as conditions CI ("current invention")a, CIb, CIc, CId. Line "A" represents the liquid point where the refrigerant turns completely liquid in the condenser; the extension of the process to the left of this line reflects the liquid being subcooled. Line "B" represents the dew point; the extension to the right of this line is superheated gas entering the compressor after being compressed in a compressor (not shown).

In FIG. 1, for each of process 1, 3, 4, 5, and CI:

- Points "a" stand for superheated refrigerant vapor leaving evaporator, entering compressor;
- Points "b" stand for compressed refrigerant vapor leaving compressor, entering condenser;
- Points "c" stand for subcooled refrigerant liquid leaving condenser, entering expansion device;
- Points "d" represents a mixture of liquid and vapor refrigerant at 50 degrees F., with an evaporator pressure of 157 psi;
- Enthalpy difference between that at points a and d represents refrigerant effect in BTUs/hr per pound of refrigerant circulation;
- Enthalpy difference between that at points b and a represents mechanical work needed to compress the refrigerant vapor to higher temperature and pressure;
- Enthalpy difference between that at points b and c represents heat removed from refrigerant vapor to liquefy and subcool refrigerant.
- There is no enthalpy difference between that at points c and d.

In FIG. 1, all frictional and thermal losses are ignored.

A chart comparing examples 1, 3, 4, and 5 with the current invention is provided in FIG. 1A.

Figure 2:
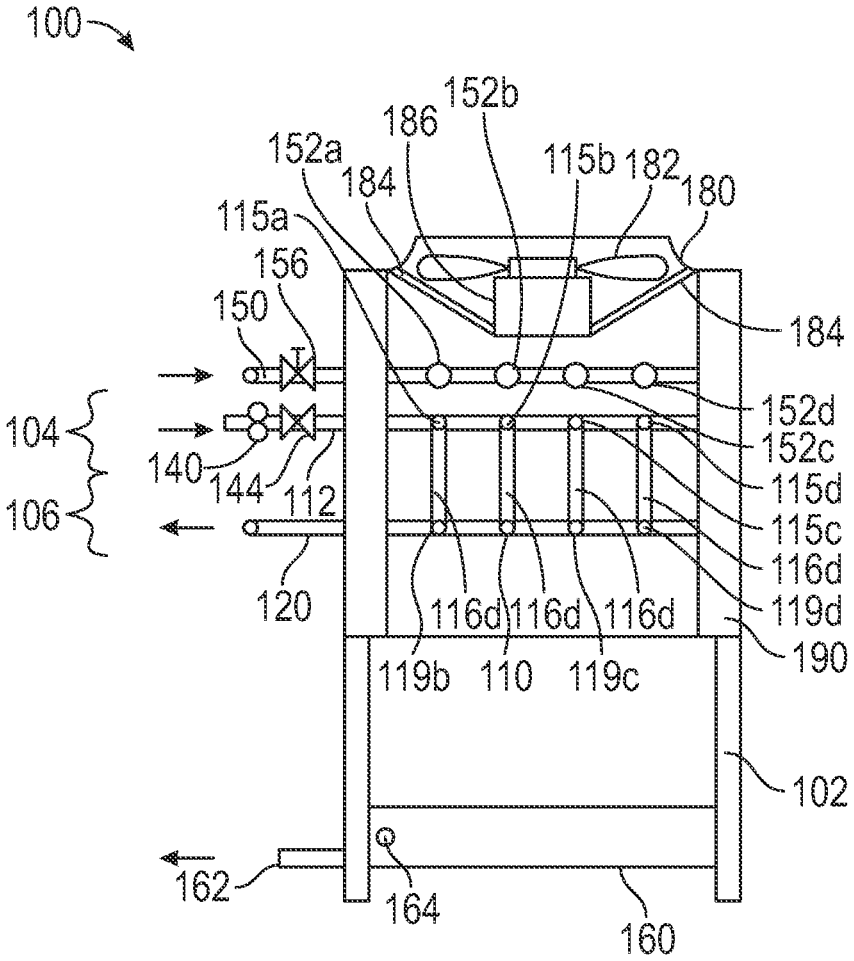
FIG. 2 is a side elevational view of an evaporative heat rejection system according to an exemplary embodiment of the current invention.
Figure 3:
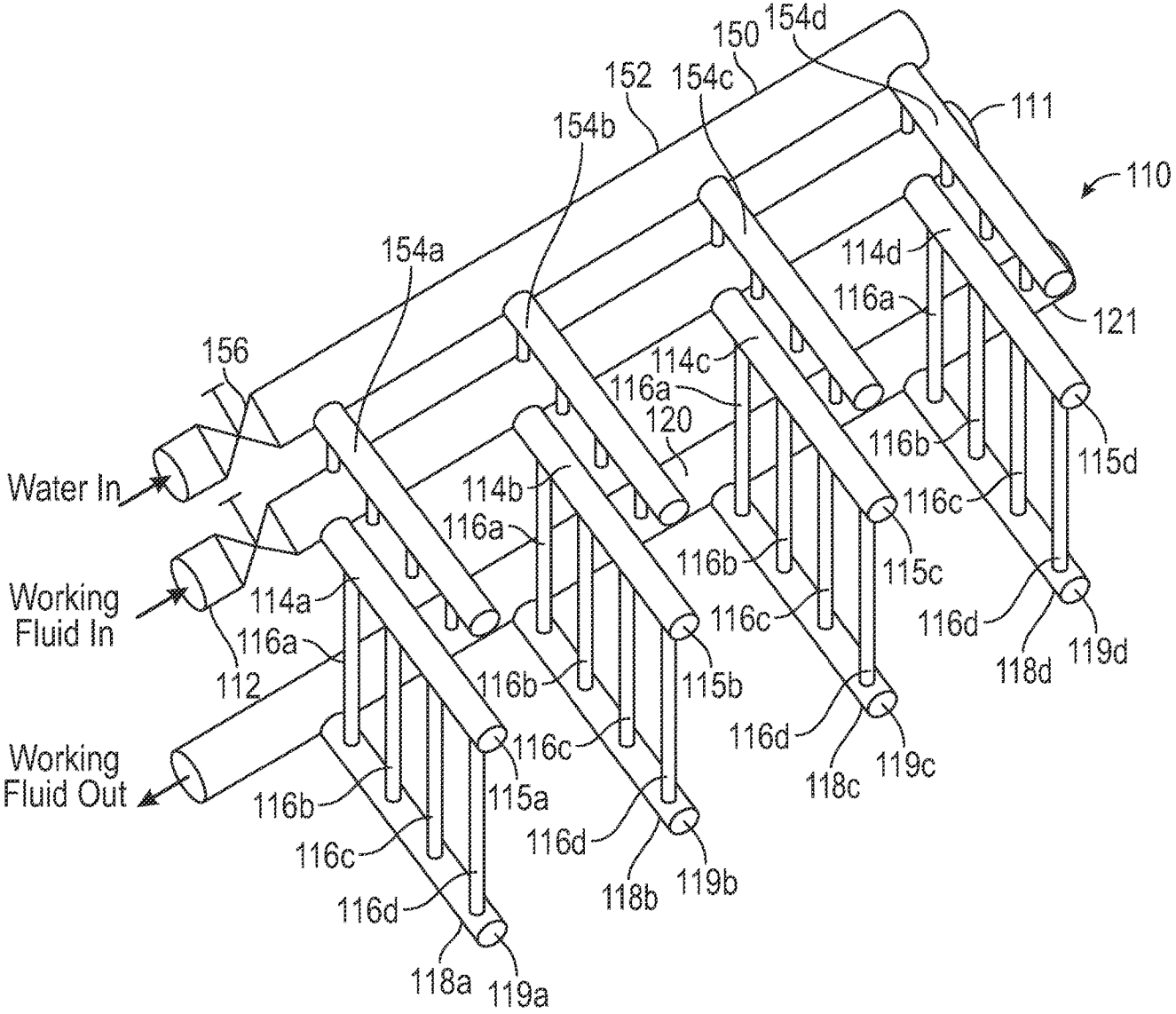
FIG. 3 is a perspective view of the fluid portion of the system of FIG. 2.
Figure 4:
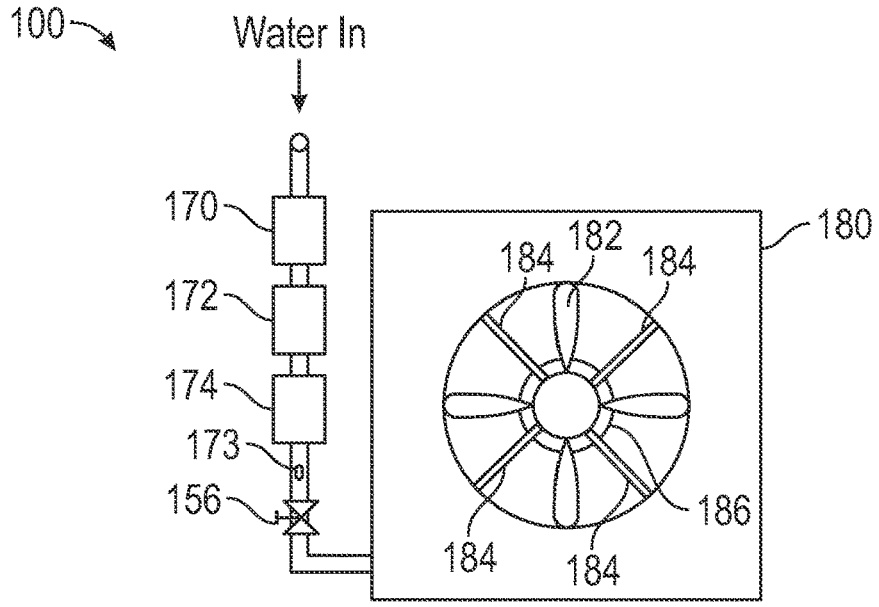
FIG. 4 is a top plan view of the system of FIG. 1.

Referring now to FIGS. 2-4, an evaporative condensing system 100 ("system 100") according to an exemplary embodiment of the current invention is shown. System 100 is used to absorb and remove heat energy from a fluid and/or solid system. The fluid system can be a closed loop or, alternatively, the fluid system can be an open system.

System 100 includes an evaporative condenser heat exchanger 110, a compressor 140 configured to circulate a working fluid through the heat exchanger 110, a water distribution system 150 adapted to deposit a controlled amount of water on the heat exchanger 110, a collector 160 below the heat exchanger 110, and an air delivery system 180 to direct air over the heat exchanger 110 from above the heat exchanger 110. An enclosure 190 encloses heat exchanger 110, water distribution system 150, water collection system 160, and air delivery system 180. In other, non refrigerant systems, the compressor 140 will be replaced with a fluid control valve, for such things as steam or chemical fluids cooling.

System 100 is built on a frame 102 that supports, in descending vertical order, air delivery system 180, water distribution system 150, heat exchanger 110, and collector 160.

The condenser heat exchanger 110 comprises a, generally horizontal header inlet 113 that deadheads at an end 111. Compressor 140 is at an upstream end of horizontal header inlet 113 and forces a working fluid into and through heat exchanger 110.

A first plurality of upper horizontal manifold lines 114*a*-114*d* extends from and is in fluid communication with the header inlet 113 and each manifold line 114*a*-114*d* deadheads at an end 115*a*-115*d*. A second plurality of vertical risers 116*a*-116*d* descends from and is in fluid communication with each of the upper horizontal manifold lines 114*a*-114*d* and a third plurality of lower horizontal manifold lines 118*a*-118*d* that each dead head at an end 119*a*-119*d*. A generally horizontal header outlet 120 that dead heads at end 121 is in fluid communication with the third plurality of lower horizontal manifold lines 118*a*-118*d* and directs cooled working fluid from condenser heat exchanger 110.

In an exemplary embodiment, the first plurality of upper horizontal manifold lines 114*a*-114*d* can be four in number and the third plurality of lower horizontal manifold lines 118*a*-118*d* can also be four in number, although those skilled in the art will recognize that more or less than four upper horizontal manifolds lines 114*a*-114*d* and more or less than four lower horizontal manifold lines 118*a*-118*d* can be provided, as long as the number of manifold lines 114*a*-114*d*, 118*a*-118*d* are the same.

The generally horizontal header outlet 120 is located vertically below the generally horizontal header inlet 113 and each of the second plurality of vertical risers 116*a*-116*d* extends parallel to an adjacent of the second plurality of vertical risers 116*a*-116*d*.

Evaporative condenser heat exchanger 110 has an outer surface 112 that is a superhydrophilic surface. The superhydrophilic outer surface 112 of heat exchanger 110 is a critical part of the claimed invention. The superhydrophilic outer surface 112 comprises a property that spreads water in a thin film upon contact with surface 112. The superhydrophilic properties allow the water from the water distribution system 150 to spread rapidly and thoroughly along the generally horizontal header inlet 113, the first plurality of upper horizontal manifold lines 114*a*-114*d*, the second plurality of vertical risers 116*a*-116*d*, the third plurality of lower horizontal manifold lines 118*a*-118*d*, and the generally horizontal header outlet 120 to increase heat transfer across those conduits.

An exemplary superhydrophilic polymer can be zwitterionic poly(sulfobetaine methacrylate) (pSBMA) or a phytlic acid based coating to achieve superhydrophilicity, although those skilled in the art will recognize that other superhydrophilic materials can be used as well. In an exemplary embodiment, the superhydrophilic surface comprises a surface with water contact angle (WCA) of less than 10 degrees within 0.5 seconds, when a water drop is placed on the surface or a surface with a property to spread water drop in a thin water film within 0.5 seconds.

Compressor 140 circulates the working fluid through the heat exchanger 110. In an exemplary embodiment, the working fluid can be a refrigerant, steam, or other known fluid that needs to be cooled. While the invention has been specifically described with respect to R-410A refrigerant, those of ordinary skill will readily understand that the invention is not limited to that refrigerant. Others, by way of example and not limitation, include a range of refrigerants.

Water distribution system 150 is adapted to deposit a controlled amount of water in water drop/drip form on the heat exchanger 110 to absorb heat from the heat exchanger 110 by evaporation of water from the heat exchanger 110.

The water distribution system 150 comprises a generally horizontal water header inlet 152 and a plurality of horizontal water drip lines 154*a*-154*d* extending from and in fluid communication with the water header inlet 152. Each of the plurality of horizontal water drip lines 154*a*-154*d* is aligned to extend vertically over one of the first plurality of upper horizontal manifold lines 114*a*-114*d*. The drip lines 154*a*-154*d* have a number of drip nozzles as necessary to distribute water to completely cover the heat exchanger surface with thin water film when water is needed per the control scheme. Drip lines 154*a*-154*d* are in a close proximity so that the water drip does fall directly over the horizontal manifold lines 114*a*-114*d* and not get deflected from the horizontal manifold lines 114*a*-114*d*.

The water distribution system 150 supplies water to the upstream portion 104 of the heat exchanger 110 in sufficient quantity that the water wets the heat exchanger 110, keeps the heat exchanger 110 wet with thin water film from the upstream portion 104 to the downstream portion 106, after the evaporative losses of water, and excess water remains to carry dissolved solids to the collector 160.

The water distribution system 150 supplies enough water to provide excess water to carry enough dissolved solids to the collector 160. such that scale from precipitated solids in the water does not build up on the heat exchanger 110 surface. Due to superhydrophilicity of the heat exchanger surface, it is self-cleaning, without debris, water or precipitation of solids.

The water distribution system 150 includes control valve 156 that permits the rate of water flow to be adjusted to achieve a level of water flow to provide excess water to carry enough dissolved solids to the collector 160 such that scale from precipitated solids in the water does not build up on the heat exchanger 110 in sufficient quantity to degrade thermal transfer performance in a commercially significant amount, in correspondence with an expected dissolved solids concentration in the water.

The water drip lines 154*a*-154*d* may be configured like drip irrigation tubes. For example, RAIN BIRD™ Multi Outlet XERIBUG™ may be use as distributors and XERIBUG™ emitters as the outlets, available from RainBird.com. The RAIN BIRD™ devices are available for various flow capacities, and it is within the scope of invention to select the flow capacity of the water supply device to achieve the flow parameters guided by the principles of the invention.

Alternatively, the water distribution system 150 may include an adjustment, such as a variable flow control valve 156, shown schematically in FIG. 2-4, or a water electrical conductivity sensor 173 that permits the rate of water flow to be adjusted to achieve a desired level of concentration of dissolved solids in the water in the collector 160, using the principles of this invention. This adjustment is typically done to optimize the water consumption. This is achieved with help of another water electrical conductivity sensor 164 in collector 160.

Optionally, as shown in FIG. 4, a water softener 170, a water filter 172, and a pressure regulator valve 174 can be provided upstream of control valve 156.

Figure 5:
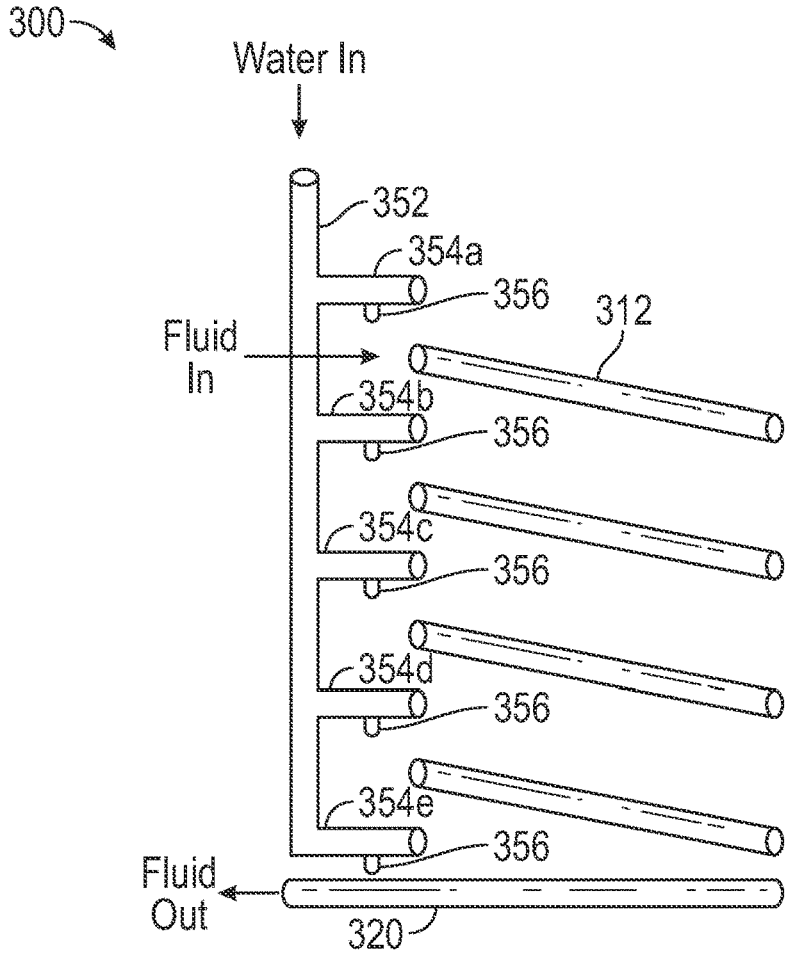
FIG. 5 is a side elevational view, in section, of an alternative embodiment of an evaporative heat rejection system.

FIG. 5 is a side elevational view, in section, of an alternative embodiment of an evaporative heat rejection system 300 according to the current invention. System 300 contains all the parts from system 100, except for heat exchanger 110 and water distribution system 150. In system 300, the working fluid is provided in a helical tube 312 and the coolant is provided via a supply pipe 352. Tube 312 is constructed from or is coated with a superhydrophilic material.

Pipe 352 extends vertically and branches into a plurality of generally horizontal branches 354*a*-354*e*. Drip nozzles 356 are provided along the lengths of each branch 354*a*-*e*. Nozzles 356 are arranged so that cooling water from nozzles 356 drips onto tube 312 along the length of tube 312. Any water that does not evaporate after dripping onto tube 312 rolls down tube 312 and eventually drips down to a lower portion of tube 312, to enhance the cooling effect of system 300.

In another embodiment, the water drip lines 154*a*-154*d* can be soaking hoses that release water evenly all along their lengths depositing water directly on the first plurality of upper horizontal manifold lines 114*a*-114*d*, so the water travels towards the bottom, as described above.

The desired water flow rates will be generally determined by prevailing climate and water supply conditions. Ambient air Dry Bulb (DB) temperature, Wet Bulb (WB) temperatures, and air flow rate over given heat exchanger surface affect the Evaporation rate (E), the rate at which the water is evaporated to cool refrigerant. Cycles of concentration of the leaving water=Electrical conductivity of the water in the collector divided by the electrical conductivity of water entering the water distribution system.

Water supplies almost invariably have dissolved solids, but the type and concentration of the dissolved solids varies by geography. The accumulation of these solids can lead to deposits being formed in the equipment, which can inhibit its thermal transfer efficiency and ultimately may lead to system failure. One manufacturer of recirculating systems recommends that solids be limited as set forth in Table 1:

TABLE 1

| | G210 Galvanized Steel | Stainless Steel (Optional) |
|---|---|---|
| pH | 7 to 9.0 | 6.5 to 9.0 |
| Hardness as $CaCO_3$ | 500 PPM MAX | 500 PPM MAX |
| Alkalinity as $CaCO_3$ | 500 PPM MAX | 500 PPM MAX |
| Total Dissolved Solids | 1500 PPM MAX | 2000 PPM MAX |
| Chlorides as NaCl | 750 PPM MAX | 1500 PPM MAX |
| Sulfates | 500 PPM MAX | 750 PPM MAX |

Thus, the dissolved solids in the water supply are also taken into account in determining the desired water application rate.

The concept of cycles of concentration is commonly used in industrial/commercial cooling tower and evaporative cooler operation. As water is evaporated, minerals are left behind in the recirculating water. As evaporation continues, the water becomes more concentrated than the original make up water. This eventually can lead to saturated conditions. The term "cycles of concentration" compares the level of solids of the recirculating cooling tower to the level of solids of the original raw make up water. If the circulating water has four times the solids concentration than that of the make up water, then the cycles are 4. This concentration (or greater) continually passes over the entire heat exchanger in the current practice.

Although the current invention does not involve recirculation of the cooling water, a similar nomenclature can be used. That is, the ratio of the dissolved solids concentration in the discharged water to the concentration in the applied water is herein referred to as the "cycles of concentration." Typically, the greater the applied water rate, the greater the discharged water rate, and the lower the cycles of concentration. In most instances the goal will be to apply enough water to keep the cycles of concentration low enough to prevent scale formation, but high enough to avoid excess water usage. Since the ending concentration is determinative of whether scale is likely to form, knowing the solids concentration in the input water enables the selection of appropriate cycles of concentration to prevent scale formation and avoid water wastage. It is an advantage of the preferred embodiment that only the lowermost portion or rungs of the heat rejecter or heat exchanger 110 are subject to the maximum cycles of concentration, unlike recirculating systems.

Comparative Example

Typical evaporative cooling equipment consists of a primary surface heat exchanger, installed over a water sump, enclosed in a louvered enclosure. The enclosure has mist eliminators installed, followed by a fan. Between the heat exchanger and the mist eliminators is the bank of water spray nozzles. A pump located at the base water piping between the sump and the pump inlet and pump outlet to the bank of water spray nozzles over the top of the heat exchanger. The heat exchanger is connected to the source of fluid to be cooled.

In operation, the recirculating pump is started to spray water (at flow rate $Q_{wrec}$) on the heat exchanger to wet the heat exchanger. The fan is then started to draw the air in to flow over the heat exchanger. The water wets the heat exchanger and a portion of the water evaporates (at rate $Q_{wevap}$). Some amount of water (at rate $Q_{wco}$) is airborne in the air and passes by the fan into ambient air. Also, some water entrained in the air escapes from the sides of the louvered enclosure (at a rate of $Q_{wdrift}$) due to wind. This results in loss of water from the system. In order to replace that water, make up water is added to the system (at a rate of $Q_{wmu}$).

The make up water contains (x % by weight) dissolved impurities. If the water is continuously allowed to be evaporated, then the impurities added by the make up water and left over by evaporating water will increase the dissolved salt concentration in the system water to saturation and the salt starts to precipitate on the heat exchanger surface in the form of scales. These scales cause deterioration in the heat exchanger performance. In order to avoid this, some amount of water is continuously discharged (at a rate of $Q_{wbleed}$). The amount of makeup water is adjusted to such a level that the concentration of water in the sump is maintained at c times original x % concentration to avoid precipitation. This gives the following:

Total water coming in to the system is equal to water going out.

$$Q_{wmu}=Q_{wevap}+Q_{wbleed}+Q_{wco}+Q_{wdrift} \quad \text{Eqn. 1}$$

Also total dissolved solids coming in and going out must be equal. Since the amount of water sprayed through the nozzles ($Q_{wrecirc}$) is much greater than $Q_{wevap}$, $$Q_{wmu}*x+Q_{wevap}*c*x=(Q_{wbleed}+Q_{wco}+Q_{wdrift})*c*x \quad \text{Eqn. 2}$$

$$Q_{wmu}+Q_{wevap}*c=(Q_{wbleed}+Q_{wco}+Q_{wdrift})*c \quad \text{Eqn. 3}$$

But, from Eqn. 1, $$Q_{wbleed}+Q_{wxo}+Q_{wdrift}=Q_{wmu}-Q_{wevap} \quad \text{Eqn. 4}$$

Substituting in Eqn 3, $$Q_{wmu}+Q_{wevap}*c=(Q_{wmu}-Q_{wevap})*c \quad \text{Eqn. 5}$$

$$Q_{wmu}*(c-1)=2*c*Q_{wevap} \quad \text{Eqn. 6}$$

$$Q_{wmu}=Q_{wevap}*[(2*c)/(c-1)] \quad \text{Eqn. 7}$$

From Equations (1) and (7)

$$Q_{wbleed}+Q_{wco}+Q_{wdrift}=Q_{wevap}*(c+1)/(c-1) \quad \text{Eqn. 8}$$

In current (prior art) designs, the $Q_{wco}$ and $Q_{wdrift}$ are much smaller than $Q_{wbleed}$.

$$Q_{wbleed}=Q_{wevao}*(c+1)/(c-1) \quad \text{Eqn. 9}$$

Table 2 below gives make up water required per lb/hr rate of water evaporation.

TABLE 2

| | Cycles of concentration | | | | | | |
|---|---|---|---|---|---|---|---|
| | 2 | 3 | 4 | 5 | 6 | 7 | 8 |
| Make Up water rate per lb/hr of water evaporation rate | 4.00 | 3.00 | 2.67 | 2.50 | 2.40 | 2.33 | 2.29 |
| Bleed water rate per lb/hr of water evaporation rate | 3.00 | 2.00 | 1.67 | 1.50 | 1.40 | 1.33 | 1.29 |

Example

According to the current invention, the dissolved solids can be kept below levels having adverse consequences by determining the cycles of concentration, defined below:

System 100 has once through water for evaporation, with no recirculation. Water dripped on the heat exchanger spreads on it and flows down the evaporator as portions of it evaporate to cool the fluid inside the heat exchanger. Therefore, in this case cycles of concertation are based on cycles of concentration leaving the heat exchanger. Cycles of concentration of upstream portion 104 of the heat exchanger will always be lower than downstream portion 106 of the heat exchanger.

Rate of water used in the system 100 can be defined as $Q_{win}$ lb/hr, and has dissolved solids concentration of x % by weight. Water evaporates at a rate of $Q_{wevap}$ lb/hr. Water leaving the heat exchanger 110 at rate of $Q_{wout}$ lb/hr. $Q_{wout}$ has dissolved solids concentration c times the original concentration of dissolved solids in the water entering the heat exchanger 110.

$$Q_{win}=Q_{wevap}+Q_{wout} \quad \text{Eqn. 10}$$

$$Q_{win}*x=Q_{wout}*c*x \quad \text{Eqn. 11}$$

But from Eq. 10, $$Q_{wout}=Q_{win}-Q_{wevap} \quad \text{Eqn. 12}$$

Substituting in Equation (11), $$Q_{win}*x=(Q_{win}-Q_{wevap})*c*x \quad \text{Eqn. 13}$$

$$Q_{win}=Q_{wevap}*c/(c-1) \quad \text{Eqn. 14}$$

Table 3 provides Cycles of Concentration for different values inside system 100.

TABLE 3

| | Cycles of concentration | | | | | | |
|---|---|---|---|---|---|---|---|
| | 2 | 3 | 4 | 5 | 6 | 7 | 8 |
| Input water rate per lb/hr of water evaporation rate | 2.00 | 1.50 | 1.33 | 1.25 | 1.20 | 1.17 | 1.14 |
| Drain water rate per lb/hr of water evaporation rate | 1.00 | 0.50 | 0.33 | 0.25 | 0.20 | 0.17 | 0.14 |

As the water flows down the heat exchanger 110 and reaches a point where y fraction of the water has evaporated ($Q_{wevap}$-y), cycles of concentration (cy) are $$\text{Qwin}=\text{Qwout}-y+\text{Qwevap}-y \quad \text{Eqn. 15}$$

$$\text{Qwin}*x=\text{Qwout}-y*cy*x \quad \text{Eqn. 16}$$

$$\text{Qwin}=(\text{Qwin}-\text{Qwevap})*cy \quad \text{Eqn. 17}$$

where $$cy=\text{Qwin}/(\text{Qwin}-\text{Qevap}-y) \quad \text{Eqn. 18}$$

The above analysis demonstrates the following:

System 100 requires only half amount of water for the same amount of heat exchange (cooling) compared to water required for prior art processes; system 100 significantly reduces the quantity of drain (waste) water; and system 100 significantly reduces exposure of high cycles of water. The prior art method in the Comparative Example exposes all of the heat exchanger to the same high cycles of concentration water, making the heat exchanger much more vulnerable to fouling.

Figure 6:
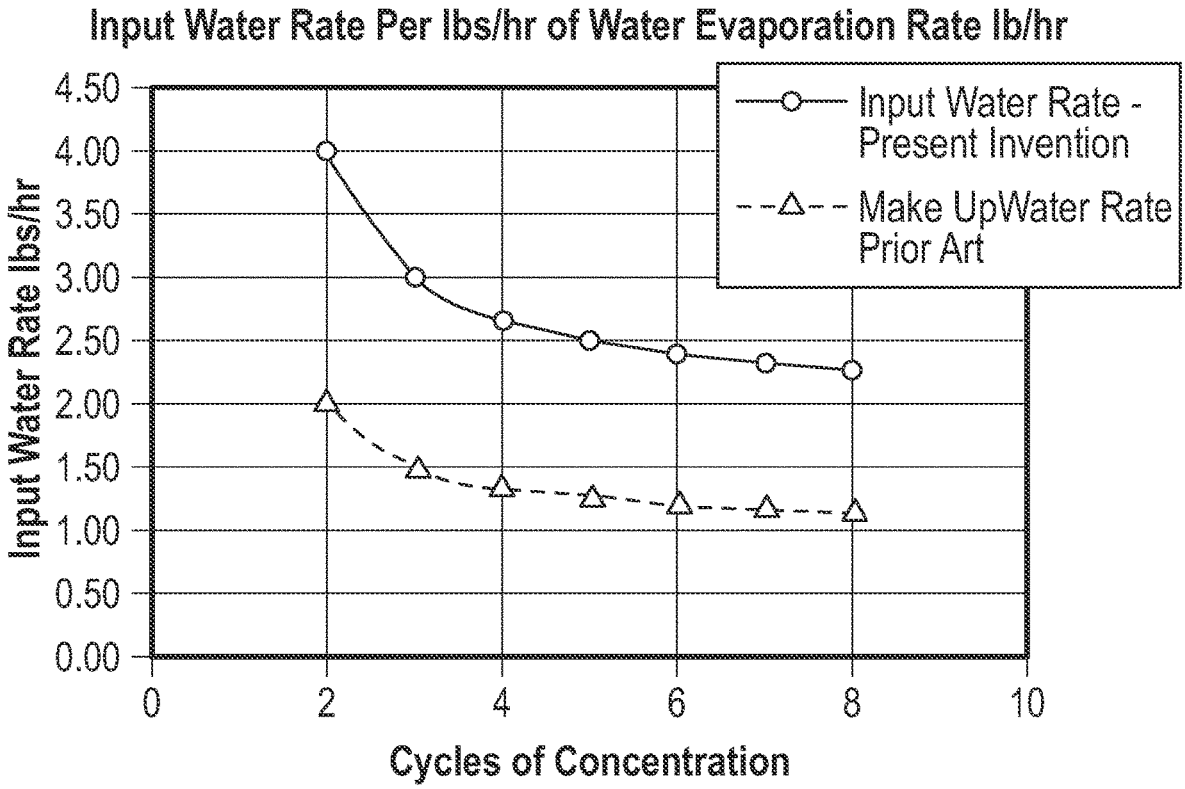
FIG. 6 is a graph that shows a dramatic decrease in the amount of input water required for cooling relative to the prior art comparative example.
Figure 7:
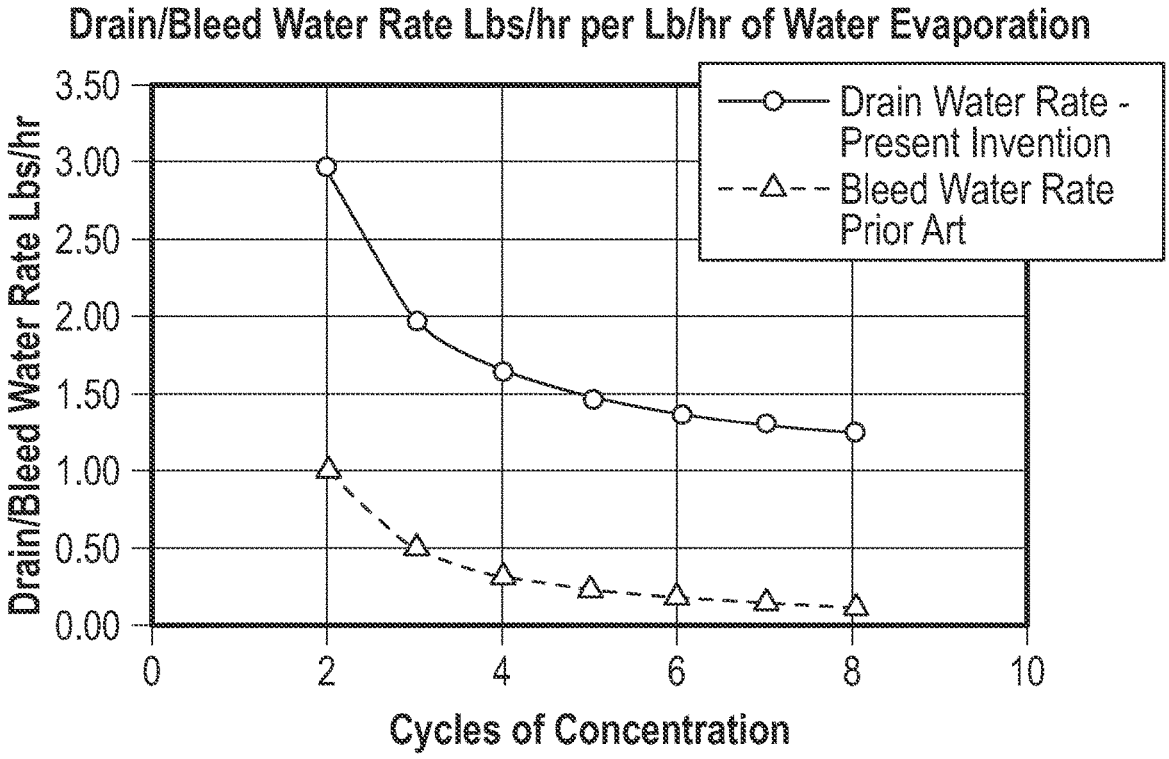
FIG. 7 is a graph that shows the dramatic decrease in the amount of drain/bleed water relative to the prior art comparative example.
Figure 8:
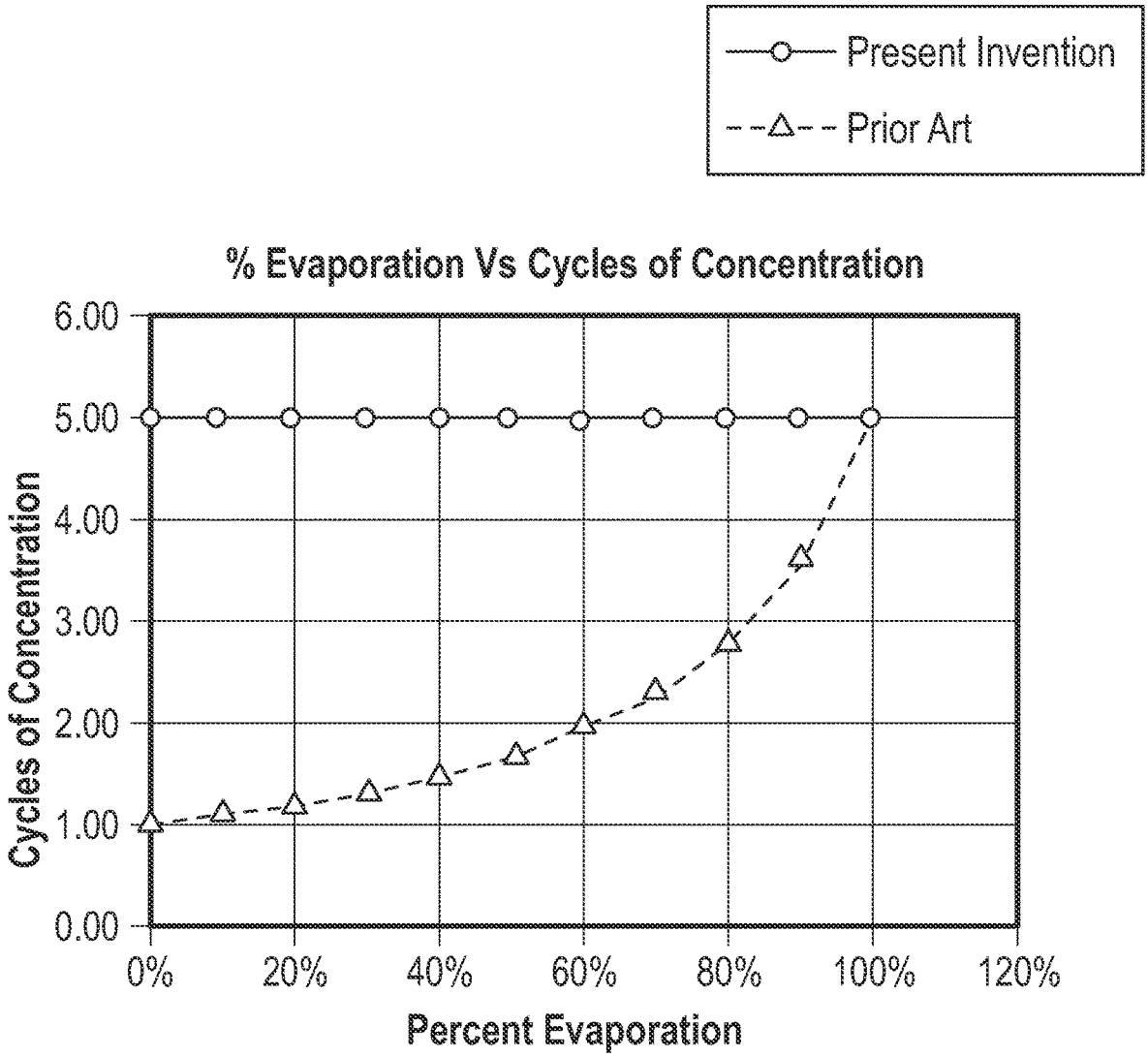
FIG. 8 is a graph that shows a dramatic reduction in the percent of cooling water evaporation vs. cycles of concentration relative to the prior art comparative example.

FIGS. 6-8 provide graphs comparing system 100 to the prior art comparative example. FIG. 6 shows a dramatic decrease in the amount of input water required for cooling relative to the prior art comparative example; FIG. 7 shows the dramatic decrease in the amount of drain/bleed water relative to the prior art comparative example; and FIG. 8 shows a dramatic reduction in the percent of cooling water evaporation on the heat exchanger portions vs. cycles of concentration relative to the prior art comparative example.

The collector 160 is located below the downstream portion 106 of the heat exchanger 110 to receive excess water from the heat exchanger 110 and direct excess water to a drain 162. Optionally, a dissolved solids sensor 164 can be located in collector 160. The dissolved solids sensors 164 and 173 placed in collector 160 and downstream of the pressure regulator 171 respectively. Both measure electrical conductivity of the water at the drain of the collector and the electrical conductivity of the water where the water enters the water distribution system.

Air delivery system 180 can be a fan 182 that is supported by a plurality of fan motor support 184 attached to frame 102. Air delivery system 180 is configured such that the airflow is provided over the heat exchanger 110 only when the fan motor 186 is turned on and is not provided or is provided minimally when the fan motor 186 is off, even when a strong wind is blowing.

A comparison of the performance of the cycle achievable with the disclosed embodiments of the current invention with typical air cooled condensing and water cooled condensing indicates that an exemplary embodiment is over 17% more efficient compared to air cooled and about 6% more efficient compared to the water cooled units.

In an exemplary embodiment of the invention, water, fresh from source, is released at various points at the top of the heat exchanger 110. As the water spreads quickly into a thin film due the superhydrophilicity and descends aided by gravity along the heat exchanger 110, a thin water film is formed on all surfaces of the heat exchanger. As air flow passes over the heat exchanger, part of the water evaporates to cool and thereby condense refrigerant inside the heat exchanger 110. Due to this evaporation, the concentration of the dissolved solids in the water increases as the water travels down the heat exchanger 110. The water leaves the last section of the heat exchanger 110 with the highest concentration of solids dissolved. In contrast, in evaporative condensing systems mentioned in methods 3 and 4 in the background of invention, as a result of recirculation of the water, all the heat transfer surfaces come in contact with water having a solid concentration equal to or greater than that leaving the heat exchanger of the current invention. The current invention, thus, dramatically reduces the scale formation on the heat transfer surfaces. This reduces maintenance, and improves performance of the system between maintenance cycles.

Figure 9:
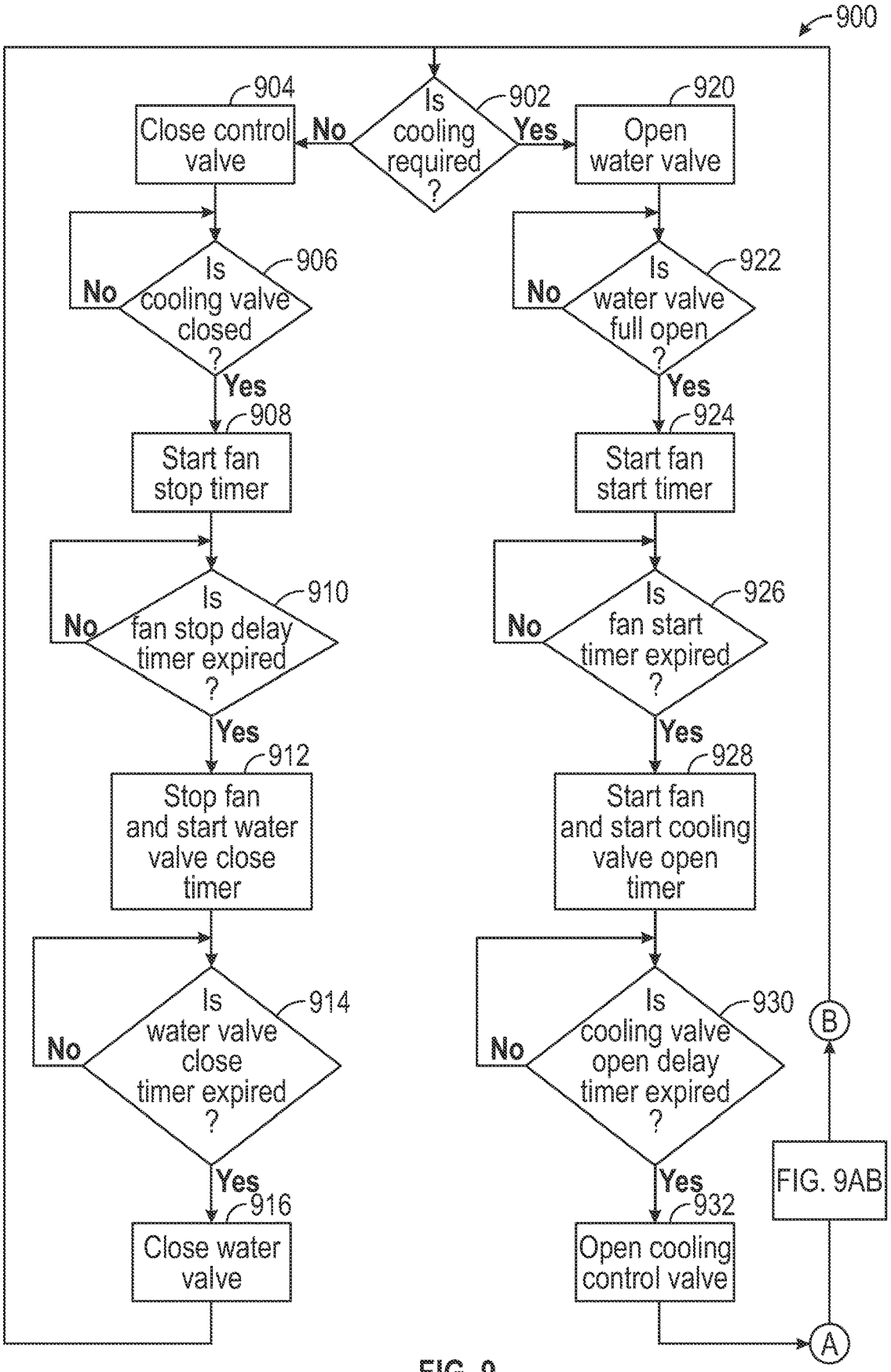
FIG. 9 is a flowchart showing cooling steps for the system of the current invention.
Figure 9A:
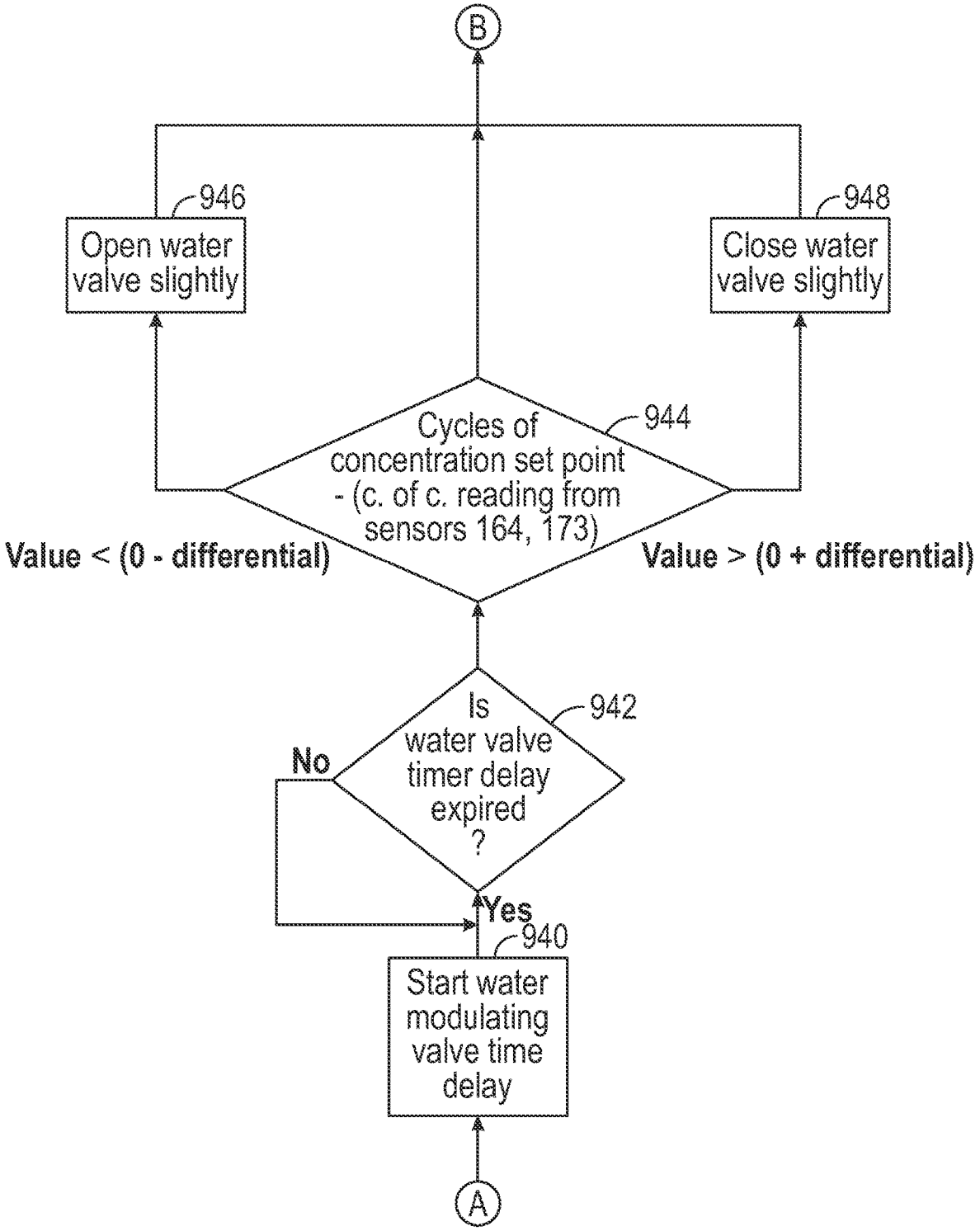
FIG. 9AB is a subset of the flowchart of FIG. 9 extending between points A and B.

FIGS. 9 and 9AB are a flowchart 900 that provide an exemplary embodiment of the operation of system 100, which shows how the current invention can achieve the dramatic reduction in the percent of cooling water evaporation on the heat exchanger portions vs. cycles of concentration relative to the prior art comparative example as shown in FIG. 8. In step 902, it is determined whether cooling is required for fluid ready to enter the heat exchanger 110. If not, in step 904, fluid control valve 144 is closed. Step 906 confirms whether fluid control valve 144—is closed. If not, step 906 is repeated.

If fluid control valve 144 is indeed closed, in step 908 a timer on fan stop 182 is started. In step 910, an inquiry is made into whether the fan stop timer is expired. If not, step 910 is repeated.

If so, in step 912, fan 182 is stopped and a timer to close control valve 156 is started. If the timer to close water control valve 156 is determined to be expired in step 914, then in step 916, the water valve 156 is closed and the step 916 follows to close water valve 156. If not, step 914 is repeated. Otherwise, the process reverts to step 902.

At step 902, if cooling is required for the fluid to be cooled in the heat exchanger, water valve 156 is opened in step 920. Step 922 confirms whether control valve 156 is open. If not, step 922 is repeated. If control valve 156 is indeed fully open, in step 924, a fan start timer is started. In step 926, an inquiry is made to determine whether the fan start time has expired. If not, step 926 is repeated. If the timer is indeed expired, in step 928, fan 182 is started and a timer to open fluid control valve 144 is started. If the timer to close open valve 144 is determined to be not expired in step 930, then step 930 is repeated.

If the open delay timer is indeed expired, in step 932, fluid control valve 144 is opened. Next, in step 940, a water control valve modulation time delay is started. In step 942, an inquiry is made into whether the valve time delay is expired. If not, step 942 is repeated. If so, in step 944 water electrical conductivity sensor 164 in drain 160, in conjunction with water electrical conductivity sensor 173, reads the cycles of concentration. The cycles of concentration are calculated by taking the ratio of electrical conductivity of the water in the collector or drain (sensor 164) to the electrical conductivity of the water entering in the water distribution (sensor 173). The target cycles of concentration determined by the level of dissolved solids in the incoming water and maximum concentration desired is called set point for cycles of concentration. This value can be maintained between a certain tolerance. For example, if the set point for cycles of concentration is 5 and it desired to be maintained within a tolerance of 0.5 then value of differential will be 0.25. When sensed value of cycles of concentration is higher than (setpoint+differential) or (5+0.25=5.25) then it is necessary to increase the flow of incoming water by opening the water control valve 156 slightly (by 5%) at step 948 to get the value down. Conversely if the cycles of concentration value is less than (set point−differential) or (5−0.25=4.75). Then it will be necessary to reduce the water flow by closing water control valve 156 in step 946 to avoid water waste. Therefore, if value of the (Cycles of concentration setpoint−Actual cycles of concentration) is less than (0−Differential), then open the water control valve 156 slightly (about 2%). If the above value is greater than Differential, then the water control valve 156 needs to be closed slightly (about 2%). If neither of the above cases are true then the process returns to step 902. Regardless of whether control valve 156 is opened or closed based on the results of step 944, the process reverts back to step 902 to determine whether cooling is required.

In addition, because the exemplary embodiments of the invention permit the condensation of vapor at lower temperatures, a greater compressor cooling capacity results.

The reduced average concentration of the dissolved solids in the water over the heat exchanger 110, enables the current invention to use less water than the evaporative condensing systems mentioned in methods 3, 4, 5 in the background of invention.

Airflow over the heat exchanger 110 is controlled with the placement of the air flow guide to minimize the incidence of dust and dirt in the surroundings on the heat exchanger 110. This is achieved by having the air change direction by 90 degrees and keeping the velocity of the air immediately after this turn lower than the velocity over the heat exchanger 110. Any dirt coming in contact with the heat exchanger 110 would have to travel against gravity to be deposited on the heat exchanger 110. The self cleaning property of the superhydrophilic heat exchanger surface helps keep the heat exchanger cleaner and efficient over longer periods than possible with any prior methods.

An air shield (not shown) and/or other devices like enclosures with dampers used to control air flow reduces the compressor noise escaping the condensing apparatus, thus providing quieter operation compared to other condensing units. Dampers can also be used to close off the airflow passages when airflow is not needed.

Figure 10:
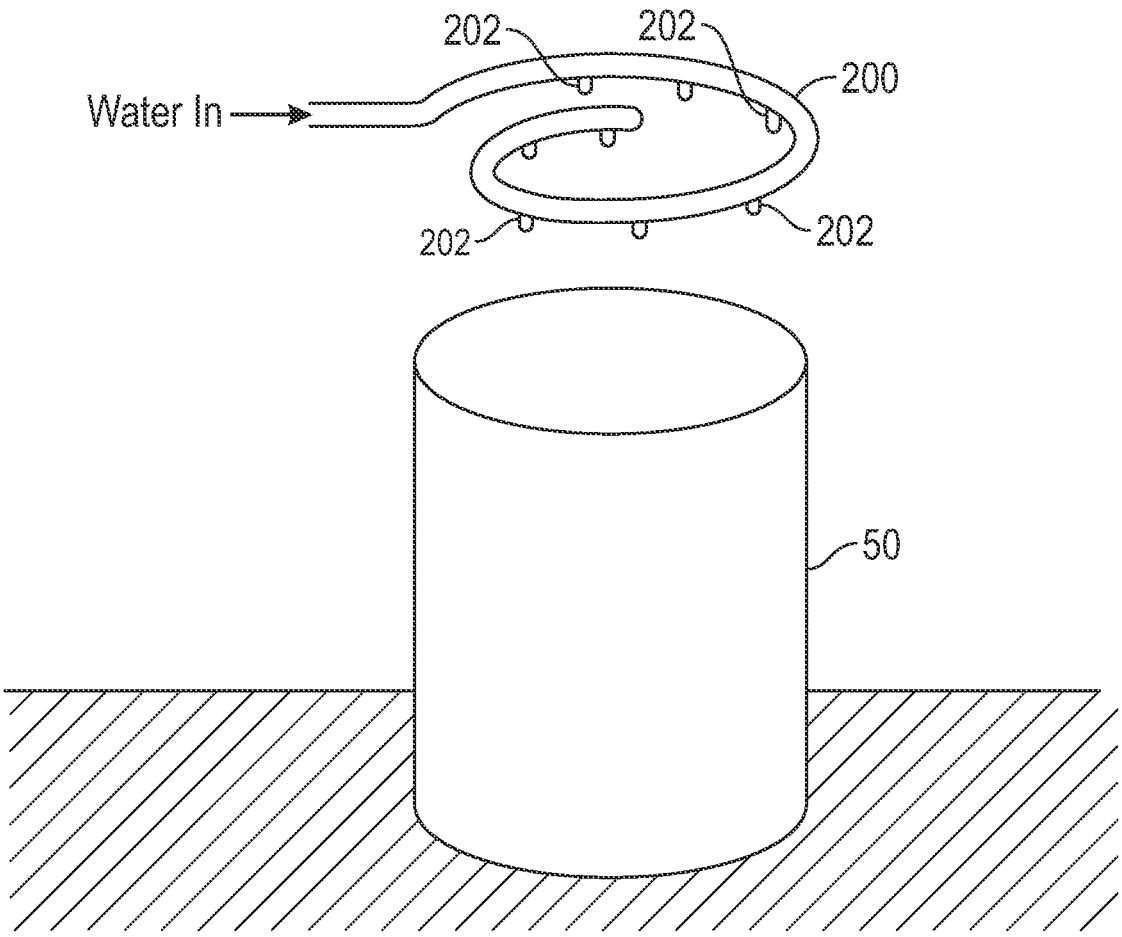
FIG. 10 is a perspective view of an alternative embodiment of the current invention using solid instead of fluid to dissipate heat.

Referring now to FIG. 10, while system 100 cools a fluid, such as water, to flow through and dissipate heat energy, an alternative embodiment of a system 200 uses a solid 50 with a superhydrophilic surface outer surface. This is achieved simply by replacing the heat exchanger by the solid object 50, such as, for example, a compressor with hot surface as long as the hot surface of the solid object 50 is superhydrophilic. The geometry of the water distribution can be modified to provide water droplets or drips through nozzles 202 as needed. The water distribution system will be the same.

While specific examples of configurations of heat exchangers are shown and described above, those skilled in the art will recognize that the principles of the current invention can be used for other configurations of heat exchangers that incorporate water dripping onto a superhydrophilic surface of the heat exchanger.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. An evaporative condensing system comprising:

an evaporative condenser heat exchanger having an outer surface and extending from an upper portion to a lower portion, the outer surface being a superhydrophilic surface;

a compressor configured to circulate a working fluid through the evaporative condenser heat exchanger;

a water distribution system having a plurality of openings disposed directly over the upper portion adapted to gravity deposit a controlled amount of water on the evaporative condenser heat exchanger to absorb heat from the evaporative condenser heat exchanger by evaporation of water from the evaporative condenser heat exchanger;

a collector below the lower portion of the evaporative condenser heat exchanger to receive excess water from the evaporative condenser heat exchanger and direct the excess water to a drain; and an air delivery system to direct air over the evaporative condenser heat exchanger, wherein the water distribution system supplies water to the upper portion of the evaporative condenser exchanger in sufficient quantity that the water wets the evaporative condenser heat exchanger, keeps the evaporative condenser heat exchanger wet from the upper portion to the lower portion, even with the evaporative losses of water, and excess water remains to carry dissolved solids to the collector.

2. The system according to claim 1, wherein the water distribution system supplies only enough water to provide excess water to carry enough dissolved solids to the collector such that scale from precipitated solids in the water does not build up on the evaporative condenser heat exchanger in sufficient quantity to degrade thermal transfer performance.

3. The system according to claim 2, wherein the water distribution system includes an adjustment that permits the rate of water flow to be adjusted to achieve a level of water flow to provide excess water to carry enough dissolved solids to the collector such that scale from precipitated solids in the water does not build up on the evaporative condenser heat exchanger in sufficient quantity to degrade thermal transfer performance, in correspondence with an expected dissolved solids concentration in the water.

4. The system according to claim 1, wherein the air delivery system includes a fan and wherein the fan is configured such that the airflow is over the evaporative condenser heat exchanger only when the fan motor is turned on and is not provided or is provided minimally when the fan motor is off, even when a strong wind is blowing.

5. The system according to claim 1, wherein the superhydrophilic surface comprises a surface with water contact angle (WCA) of less than 10 degrees.

6. The system according to claim 1, wherein the superhydrophilic surface comprises a property to spread water in a thin film upon contact.

7. The system according to claim 1, wherein the working fluid comprises a refrigerant.

8. The system according to claim 1, wherein the working fluid comprises steam.

9. The system according to claim 1, wherein the working fluid comprises a liquid.

10. The system according to claim 1, wherein the working fluid comprises a gas.

11. The system according to claim 1, further comprising a water electrical conduction sensor in the collector, the sensor configured to determine cycles of concentration of the excess water to be drained.

12. The system according to claim 1, wherein the system is configured to cool a fluid.

13. The system according to claim 1, wherein the system is configured to cool a solid.

14. An evaporative condensing system comprising:

an evaporative condenser heat exchanger having an outer surface and extending from an upper portion to a lower portion, the outer surface being a superhydrophilic surface;

a compressor configured to circulate a working fluid through the evaporative condenser heat exchanger;

a water distribution system adapted to deposit a controlled amount of water on the evaporative condenser heat exchanger to absorb heat from the evaporative condenser heat exchanger by evaporation of water from the evaporative condenser heat exchanger;

a collector below the lower portion of the evaporative condenser heat exchanger to receive excess water from the evaporative condenser heat exchanger and direct the excess water to a drain; and an air delivery system to direct air over the evaporative condenser heat exchanger, wherein the water distribution system supplies water to the upper portion of the evaporative condenser heat exchanger in sufficient quantity that the water wets the evaporative condenser heat exchanger, keeps the evaporative condenser heat exchanger wet from the upper portion to the lower portion, even with the evaporative losses of water, and excess water remains to carry dissolved solids to the collector, and wherein the evaporative condenser heat exchanger comprises a generally horizontal header inlet, a first plurality of upper horizontal manifold lines extending from and in fluid communication with the header inlet, a second plurality of vertical risers descending from and in fluid communication with the upper horizontal manifold lines, a third plurality of lower horizontal manifold lines in fluid communication with the second plurality of vertical risers, and a generally horizontal header outlet in fluid communication with the third plurality of lower horizontal manifold lines.

15. The system according to claim 14, wherein the first plurality and the third plurality comprise the same number.

16. The system according to claim 15, wherein the first plurality and the third plurality comprise four.

17. The system according to claim 14, wherein the generally horizontal header outlet is located vertically below the generally horizontal header inlet.

18. The system according to claim 14, wherein each of the second plurality of vertical risers extends parallel to an adjacent of the second plurality of vertical risers.

19. The system according to claim 14, wherein the water distribution system comprises a generally horizontal water header inlet and a plurality of vertical water drip nozzles on lines extending from and in fluid communication with the water header inlet.

20. The system according to claim 19, wherein each of the plurality of horizontal water drip lines extends vertically over one of the first plurality of upper horizontal manifold lines.

21. The system according to claim 14, wherein the vertical risers extend in a helical pattern.

22. An evaporative condensing system comprising:

a heat exchanger having a superhydrophilic exterior surface;

a water distribution system configured to drip water directly on the heat exchanger;

a water collection system configured to collect the water after the water is dripped onto the heat exchanger;

an air delivery system configured to move air over the heat exchanger;

an enclosure enclosing the heat exchanger, the water distribution system, the water collection system, and the air delivery system, a first sensor in the water distribution system; and a second sensor in the water collection system, wherein a value determined by the second sensor divided by a value determined by the first sensor determines the cycles of concentration of water in the water distribution system and the water collection system.

* * * * *